US006443852B1

(12) United States Patent
Kim

(10) Patent No.: US 6,443,852 B1
(45) Date of Patent: Sep. 3, 2002

(54) PUTTING GUIDE

(76) Inventor: Jack T. B. Kim, 3440 Sierra Rd., San Jose, CA (US) 95132

( * ) Notice: Subject to any disclaimer, the term of this patent is extended or adjusted under 35 U.S.C. 154(b) by 0 days.

(21) Appl. No.: 09/494,462

(22) Filed: Jan. 31, 2000

(51) Int. Cl.[7] ..... A63B 69/36

(52) U.S. Cl. ..... 473/265; 473/278; 473/257; 473/261

(58) Field of Search ..... 473/218, 219, 473/266, 270, 278, 257, 261, 265, 264

(56) References Cited

U.S. PATENT DOCUMENTS 1,545,648 A * 7/1925 Fletcher ..... 473/218
3,860,247 A * 1/1975 Taylor ..... 473/218
3,934,874 A * 1/1976 Henderson ..... 473/265
4,230,319 A * 10/1980 Lindner ..... 473/265
4,423,875 A * 1/1984 Miller ..... 473/265
4,544,160 A * 10/1985 Miner ..... 473/218
5,586,945 A * 12/1996 Vonderhaar ..... 473/261 X
5,776,007 A * 7/1998 Kendall et al. ..... 473/261 X
5,882,267 A * 3/1999 Roe ..... 473/265
6,129,639 A * 10/2000 Brock et al. ..... 473/264 X

* cited by examiner

*Primary Examiner*—Raleigh W. Chiu

(57) ABSTRACT

This invention is comprised of an apparatus which provides improved means for perfecting the art of putting of a golf ball by a golfer. It allows for refining a golfer's putting skill by making the starting and ending points of the putting stroke easy to evaluate. The apparatus is a rectangualr frame which is placed on the ground with the head of the putter inside the frame and perpendicular to the long sides of the frame. A golf ball is placed on the ground roughly in the center of the frame. The putter is drawn back a given distance to the edge of an adjustable backstop. At the end of the stroke the putter just contacts a flexible rod whose positoin along the frame can be adjusted. The frame has both fixed and adjustable markings to allow the golfer to judge the beginning of the putting stroke and the follow through.

17 Claims, 3 Drawing Sheets

PUTTING GUIDE

FIELD OF INVENTION

This invention relates generally to an improved and more efficient means for teaching a person how to putt a golf ball accurately. More particularly it relates to improved training means which allow golfers to practice putting while more accurately judging their individual putting techniques.

PRIOR ART

As noted in the attached Form POT-1449, no prior art can be found for the improvements. No usage can be found of an adjustable backstop from which to commence the putting stroke. No usage can be found of a adjustable, flexible indicator at or near the end of a putting stroke which indicates the actual amount of follow-through to allow a golfer to achieve a more consistent putting stroke.

CROSS-REFERENCES

NONE

STATEMENT REGARDING THE USE OF FEDERAL FUNDS

No federal funding, direct or indirect, has been utilized in conjunction with the development of the present invention.

STATEMENT REGARDING MICROFISCHE RECORDS

No microfische records are used in the application submitted for the present invention.

SUMMARY OF THE INVENTION

It is a general object of the present invention to provide an improved means for perfecting the art of putting of a golf ball by a golfer. More particularly the preferred embodiment of the present invention allows for refining a golfer's putting skill by making the starting and ending points of the puffing stroke easy to evaluate. The training apparatus used is a rectangualr frame which is placed on the ground with the head of the putter inside the frame and perpendicular to the long sides of the frame. A golf ball is placed on the ground in the center of the frame. The putter is drawn back a given distance to the edge of an adjustable backstop. At the end of the putting stroke the putter just contacts a flexible rod whose position along the frame is adjustable. The frame also has both fixed and adjustable markings to allow the golfer to judge distances.

BEST MODE FOR CARRYING OUT INVENTION

Figure 1:
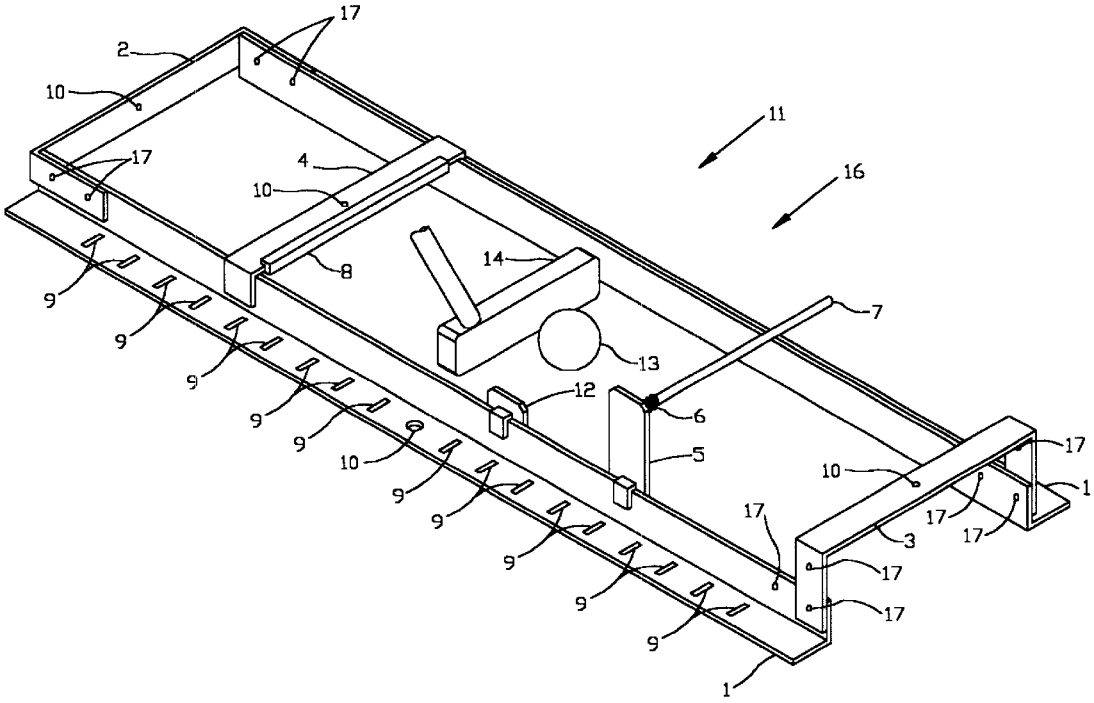
FIG. 1. A perspective view of the putting guide.
Figure 2:
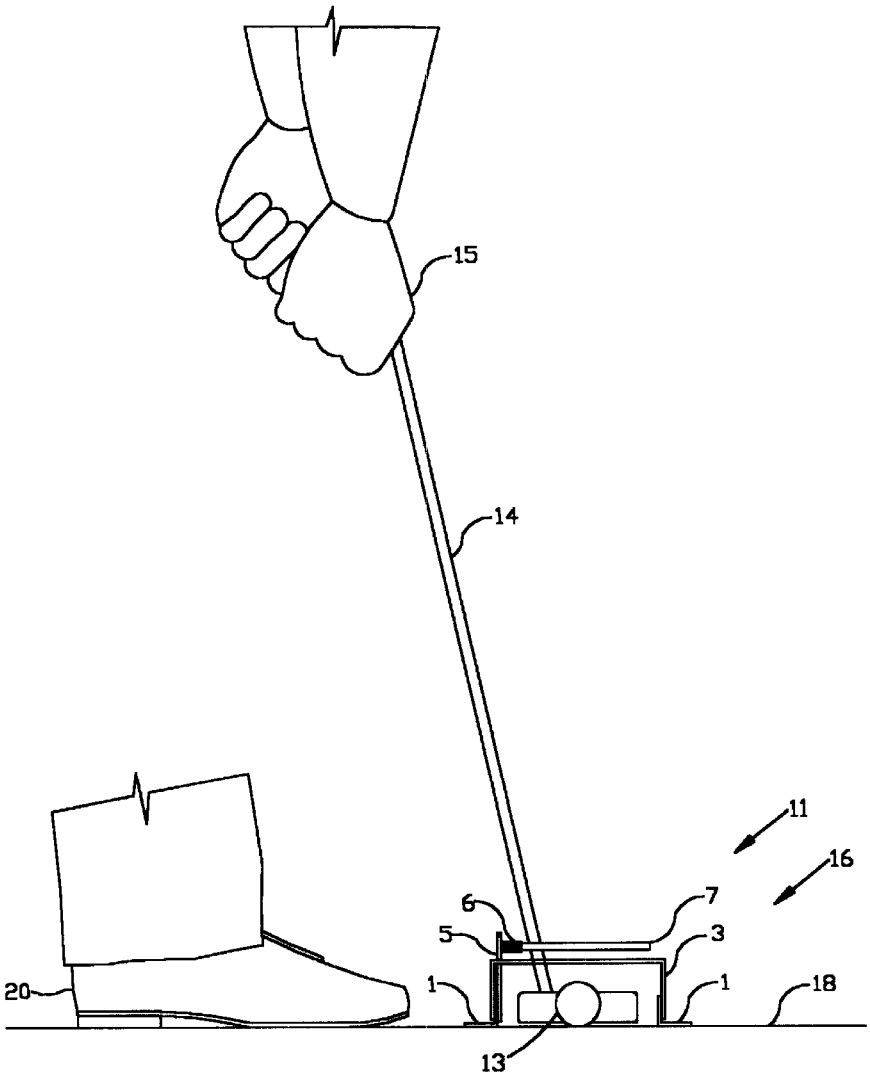
FIG. 2. An end view of the putting guide.
Figure 3:
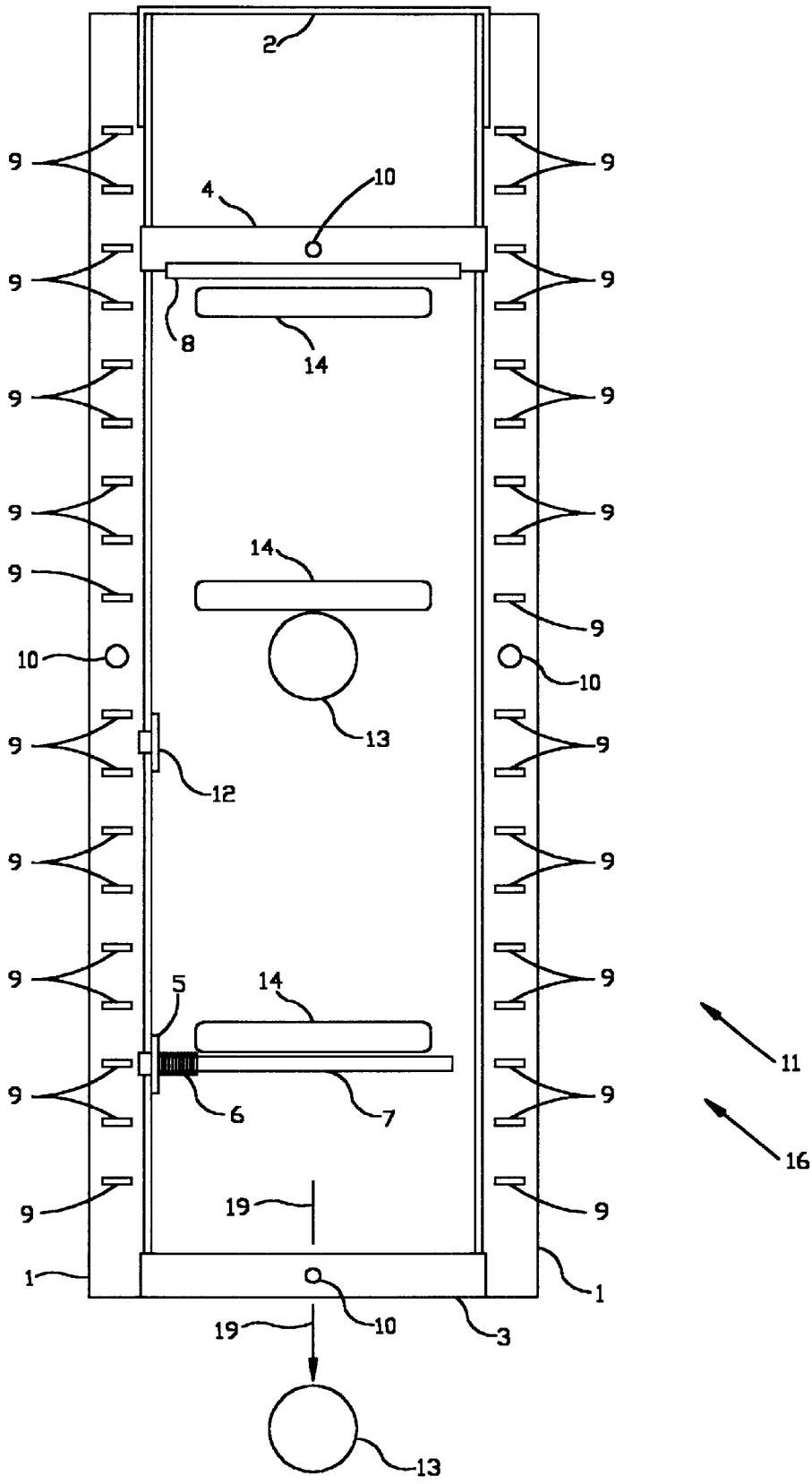
FIG. 3. A top view of three positions of a putter when using the putting guide.

The best presently known mode for carrying out the present invention is a training apparatus generally designated as the putting guide. Referring particularly to the figures wherein like-referenced numbers have been applied to like-parts throughout the description, the putting guide being designated by the general reference character 11. FIG. 1 shows a perspective view of the putting guide 11. FIG. 2 shows an end view of the putting guide 11. FIG. 3 shows a top view of the putting guide 11.

Referring particularly to FIG. 1, a rectangular frame designated by the general reference number 16, is formed by two long parallel side pieces 1 and two end pieces 2, 3 which in the preferred embodiment of the present invention, are removably attached to either ends of said side pieces 1 in either an upright position, designated as the open end 3, giving clearance for the passage of a golf ball thereunder, or in a flat position, designated as the flat end 2. In the preferred embodiment of the present invention, the side pieces 1 are comprised of metal angles with one leg upright and the other leg flat and facing outward from the frame 16. Two attachment holes 17 are located along each end of each of the side pieces 1 on their upright edges. These mate with corresponding attachment holes 17 in the ends of the open end 3 or of the flat end 2 when the frame 16 is assembled. The head of the putter 14 is constrained to travel parallel to the long sides 1 of the frame 16 by suitably wide end pieces 2, 3.

When in use, the putting guide 11 is placed on a flat level surface such as turf, artificial turf, a carpet, bare ground or other suitable surface, any or all of which are designated by the reference number 18. An adjustable backstop 4 is situated on the tops of said side pieces 1 and can be positioned along them by sliding the backstop 4. The head of a putter 14 is in contact with the backstop 4 at the start of the putting stroke. A slider 5 is flexibly connected to a rod 7 and is positioned on the top of one of said side pieces 1 at or near the position where the putting stroke will end. Said slider 5 with its rod 7 is positioned to just contact the head of the putter 14 when the length of the putting stroke or of the so called follow-through is correct. Said rod 7 is affixed to the slider 5 by a spring 6. Adjustable markers 12 are placed on the tops of the sides 1, on the backstop 4 and/or on the end pieces 2, 3 to visually assist the golfer when practicing.

In the preferred embodiment of the present invention, said side pieces 1 display spaced distance markings 9 on the tops of their flat outer surfaces. Other visual references used include center marks 10 on the side pieces 1, in the middle of said distance markings 9, on the mid points of the-end pieces 2, 3 and on the center of the backstop 4, all of which permit consistent, centered placement of the golf ball within said frame 16. Said distance and center markings 9, 10 preferably are perforations in the metal.

A putter guard 8 is affixed to the edge of the backstop 4 which contacts the head of the putter 14 at the commencement of the putting stroke to avoid scarring or damaging the putter 14. In the preferred embodiment of the present invention, said putter guard 8 is a piece of channel shaped plastic which slips over the backstop 4. Any suitable soft material however can be used.

Referring particularly to FIG. 2, a schematic representation of the relationship of the golfer's hands 15, feet 20, the putter 14 and an end view of the putting guide 11 are shown. Also the sides 1 and the open end 3 of the frame 16, the golf ball 13, the slider 5, the spring 6, and the rod 7 are shown.

Referring particularly to FIG. 3, a golf ball 13 is shown in its initial position in the center of the frame 16 and as it leaves the putting guide 11 as shown by the motion arrow 19 which indicates the passage of said golf ball 13 under the end piece 3. Also shown is the position of the head of the putter 14 at the backstop 4 when the putting stroke commences and when the putting stroke ends at or near the rod 7.

The preferred embodiment of the present invention has the distinct advantage of permitting a golfer to accurate judge and thereby improve his or her putting by accurate placement of the golf ball 13 initially and by setting the starting and ending points 4, 7 of the putting stroke. This is a new approach to improving the quality of putting by a golfer. Currently no training device has these features.

It is apparent from the foregoing that a new and improved approach to enhancing the skills required to accurately putt a golf ball has been provided. While only certain presently preferred embodiments have been described in detail, as will be apparent to those familiar with the art, certain changes and modifications can be made without departing from the scope of the invention as defined by the claims.

REFERENCE NUMERALS—DESCRIPTION

Reference Numerals - Description

| Numeral | Description |
|---|---|
| 1. | Side piece |
| 2. | End piece |
| 3. | Open end |
| 4. | Backstop |
| 5. | Slider |
| 6. | Spring |
| 7. | Rod |
| 8. | Putter guard |
| 9. | Distance markings |
| 10. | Center marker |
| 11. | General reference number for putting guide |
| 12. | Adjustable marker |
| 13. | Golf ball |
| 14. | Putter |
| 15. | Golfer's hands |
| 16. | General reference number for the rectangular frame |
| 17. | Attachment hole |
| 18. | Ground |
| 19. | Motion arrow |
| 20. | Golfer's feet |

What is claimed is:

1. A rectangular frame comprised of two long pieces attached at their ends with two shorter end pieces one of which is elevated with respect to the other parts of said frame and a horizontal flexible extension which contacts a putter at or near the end of a putting stroke with said extension adjustably affixed to one of said long pieces.

2. A rectangular frame as in claim 1, wherein the horizontal flexible extension is a rod.

3. A rectangular frame as in claim 1, wherein the horizontal flexible extension is made flexible by attachment of said extension with a spring.

4. A rectangular frame comprised of two long pieces attached at their ends with two shorter end pieces, one of which is elevated with respect to the other three pieces when the frame is placed on a level flat suface, an adjustable backstop mounted on said long parallel sides toward the end of the frame opposite to said elevated end, an adjustable flexible extension at or near the end of the elevated end of said frame which said putter contacts at or near the end of a putting stroke and with visible reference marks on the level surfaces of said frame and backstop.

5. A rectangular frame as in claim 4, wherein the adjustable flexible extension comprises a rod flexibly attached to a sliding element which straddles one of said long pieces.

6. A rectangular frame as in claim 4, wherein the reference marks are comprised of spaced indications of distance.

7. A rectangular frame as in claim 4, wherein the reference marks are comprised of a centering mark at the mid point of at least one of said long pieces.

8. A rectangular frame as in claim 4, whereby the adjustable flexible extension is made flexible by attachment of said extension with a spring.

9. A rectangular frame as in claim 4, wherein the adjustable flexible extension is comprised of a channel shaped piece snugly straddling one of said long pieces.

10. A portable apparatus for the practicing of putting golf balls comprised of a rigid rectangular frame having visible reference marks thereon and whose long parallel sides constrain the direction of the putting stroke and which has adequate clearance for the placement of the head of a putter between and perpendicular to said long parallel sides, an elevated end of said frame permitting clearance of a golf ball traveling thereunder and an adjustable backstop mounted on said long parallel sides toward the end of the frame opposite to said elevated end, whereby said adjustable backstop is freely slidable on at least one of said long parallel sides.

11. The portable apparatus of claim 10, wherein the frame is comprised to have a length to width ratio for its interior area of 5.7.

12. The portable apparatus of claim 10, wherein the frame is comprised of metal.

13. The portable apparatus of claim 10, wherein the frame is comprised of ends which are removably affixed to said long parallel sides.

14. The portable apparatus of claim 10, wherein the frame is comprised of ends pieces which are the same shape.

15. The portable apparatus of claim 10, wherein the reference marks are comprised of spaced indications of distance along the level surfaces of at least one of said long parallel sides.

16. The portable apparatus of claim 10, wherein the reference marks are comprised of a centering mark on at or near the center of least one of said long parallel sides.

17. The portable apparatus of claim 10, wherein one or more of the reference marks are comprised of attachments movable along and attached to at least one of said long parallel sides.

* * * * *